US009304429B2

(12) United States Patent
Miyagawa et al.

(10) Patent No.: US 9,304,429 B2
(45) Date of Patent: Apr. 5, 2016

(54) CHARGING MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Noboru Miyagawa, Suntou-gun (JP); Tomohito Taniguchi, Suntou-gun (JP); Masahiro Watanabe, Mishima (JP); Taichi Sato, Numazu (JP); Takehiko Aoyama, Suntou-gun (JP); Atsushi Uematsu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/838,191

(22) Filed: Aug. 27, 2015

(65) Prior Publication Data

US 2016/0062259 A1 Mar. 3, 2016

(30) Foreign Application Priority Data

Aug. 29, 2014 (JP) ..... 2014-175933

(51) Int. Cl.
*G03G 15/02* (2006.01)

(52) U.S. Cl.
CPC ..... *G03G 15/0233* (2013.01)

(58) Field of Classification Search
USPC ..... 399/107, 110, 111, 115, 130, 168, 174, 399/176; 492/18, 30
See application file for complete search history.

(56) References Cited

U.S. PATENT DOCUMENTS 5,822,658 A * 10/1998 Tanaka ..... G03G 15/0233 361/225
6,961,529 B2 * 11/2005 Kosuge ..... G03G 15/025 361/221
8,532,534 B2 * 9/2013 Taniguchi ..... G03G 15/0233 399/176
8,725,043 B2 * 5/2014 Hoshio ..... G03G 15/0233 399/176
2014/0255838 A1 9/2014 Hidekazu et al.
2014/0301754 A1 10/2014 Atsushi et al.
2014/0315686 A1 10/2014 Katsuhiro et al.

FOREIGN PATENT DOCUMENTS

JP 2008-276026 A 11/2008
JP 2011-237470 A 11/2011

OTHER PUBLICATIONS

Kamiya et al., "Optimal Design Method for Multi Dynamic Absorber", The Japan Society of Mechanical Engineers, Dec. 20, 1995, No. 95-1989, pp. 3400-3405 (22-27).
Kamiya et al., "Optimal Design Method for Multi Dynamic Absorber", The Japan Society of Mechanical Engineers, Sep. 1996, pp. 3400-3405, vol. 62, No. 601.

* cited by examiner

*Primary Examiner* — Hoan Tran
(74) *Attorney, Agent, or Firm* — Canon U.S.A., Inc. IP Division

(57) ABSTRACT

A charging member includes an electro-conductive substrate and an electro-conductive resin layer. The electro-conductive resin layer contains a binder, a plurality of bowl-shaped resin particles, and a plurality of hollow particles. The charging member has a surface having recesses due to openings of the bowl-shaped resin particles and protrusions due to edges of the openings of the bowl-shaped resin particles, where the positional relationship between one bowl-shaped resin particle and the hollow particles lying in the vicinity of the bowl-shaped resin particle is that the number of the hollow particles being in the space under the bowl-shaped resin particle in a predetermined depth is at least four in average.

5 Claims, 8 Drawing Sheets

CHARGING MEMBER, PROCESS CARTRIDGE, AND ELECTROPHOTOGRAPHIC APPARATUS

BACKGROUND OF THE INVENTION

1. Field of the Invention

The present invention relates to a charging member and to a process cartridge and an electrophotographic image-forming apparatus (hereinafter may be referred to as "electrophotographic apparatus") including the charging member.

2. Description of the Related Art

An electrophotographic apparatus employing an electrographic system is mainly composed of an electrophotographic photoreceptor (hereinafter may be simply referred to as "photoreceptor"), a charging device, an exposure device, a developing device, a transfer device, and a fixing device. The charging device can be, for example, a roller-shaped or blade-shaped member or corona wire. In particular, a roller-shaped charging member (hereinafter may be simply referred to as "charging roller") can be used. The charging device is disposed in contact with or in proximity to the surface of the photoreceptor and charges the surface of the photoreceptor by application of a voltage (a voltage of only a DC voltage or a voltage of superimposing an AC voltage on a DC voltage).

Japanese Patent Laid-Open No. 2008-276026 discloses a charging roller having protrusions due to conductive resin particles.

In the charging roller according to Japanese Patent Laid-Open No. 2008-276026, abutting of the charging roller against the photoreceptor concentrates the pressure on the protrusions due to the resin particles on the surface of the charging roller, resulting in uneven abrasion of the surface of the photoreceptor in use for a long time.

Regarding this problem, Japanese Patent Laid-Open No. 2011-237470 discloses a roller member that has an electro-conductive resin layer containing bowl-shaped resin particles each having an opening and has a surface having an uneven surface profile due to the opening portions and edge portions of the bowl-shaped resin particles. Japanese Patent Laid-Open No. 2011-237470 describes that in the roller member according to this invention, the edge portions of the bowl-shaped resin particles are elastically deformed in abutting against the photoreceptor to mitigate the abutting pressure and can prevent uneven abrasion of the photoreceptor even in use for a long time.

In addition, the literature "Optimal Design Method for Multi Dynamic Absorber, Transactions of the Japan Society of Mechanical Engineers. C 62(601) 1996/09" describes a method for designing a multi dynamic absorber.

The present invention is directed to providing a charging member that can sufficiently prevent occurrence of a banding image. The present invention is also directed to providing a process cartridge and an electrophotographic apparatus contributing to formation of a high-quality electrophotographic image.

SUMMARY OF THE INVENTION

According to one aspect of the present invention, there is provided a charging member comprising an electro-conductive substrate and an electro-conductive resin layer. The electro-conductive resin layer contains a binder, a plurality of bowl-shaped resin particles, and a plurality of hollow particles. The charging member has a surface having recesses defined by openings of the bowl-shaped resin particles and protrusions defined by edges of the openings of the bowl-shaped resin particles. The electro-conductive resin layer satisfies a positional relationship between the bowl-shaped resin particles and the hollow particles defined by requirement (1):

requirement (1): At least 4.0 hollow particles existing within a region, the region being defined by an orthographic projection of the bowl-shaped resin particle from the surface of the electro-conductive resin layer toward a depth direction, and being between the outer wall surface of a shell forming the recess of the bowl-shaped resin particle, and a plane $M_2$ which is parallel to the surface of the electro-conductive substrate and is passing through a point $p_2$ at a distance d of $b/(1+\sqrt{2})$ (μm) in the depth direction, from a point $p_1$ at the deepest position of the outer wall surface of the shell, where the symbol b in "$b/(1+\sqrt{2})$" represents a particle diameter (μm) of the bowl-shaped resin particle by spherical approximation. According to another aspect of the present invention, there is provided a process cartridge including the charging member integrated with at least a body to be electrified and being detachably attached to a main body of an electrophotographic apparatus. According to further aspects of the present invention, there is provide an electrophotographic apparatus at least including the charging member, an exposure device, and a developing device.

Further features of the present invention will become apparent from the following description of exemplary embodiments with reference to the attached drawings.

DESCRIPTION OF THE EMBODIMENTS

Figure 1:
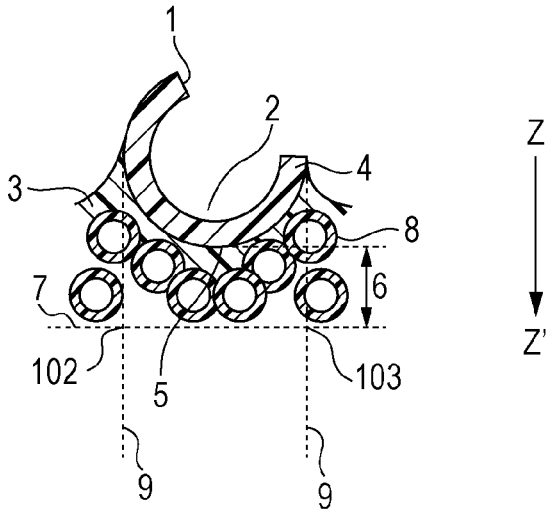
FIG. 1 is a partial cross-sectional view in the vicinity of the surface of a charging member according to the present invention.

In the charging roller according to Japanese Patent Laid-Open No. 2011-237470, the edge portions of the opening portions of the bowl-shaped resin particles are elastically deformed to mitigate the abutting pressure against the photoreceptor, which prevents uneven abrasion of the surface of the photoreceptor even in use for a long time. The roller member according to Japanese Patent Laid-Open No. 2011-237470, however, has a risk of reducing the rotation performance (hereinafter may be referred to as "following rotation") with the rotation of the photoreceptor.

In recent years, the photoreceptor has been readily vibrated in formation of an electrophotographic image with an increase in the process speed of the electrophotographic apparatus. In addition, there is a tendency of reducing the diameter of the charging roller used in electrophotography due to reductions in cost and size, resulting in a more disadvantageous structure for preventing vibration.

When a photoreceptor is charged by abutting a charging roller being low in following rotation against the photoreceptor being in vibration, the charging roller may not be able to follow the rotation of the photoreceptor to cause a phenomenon of slipping of the charging roller on the surface of the photoreceptor (hereinafter may be referred to as "stick slip"). Occurrence of the stick slip causes unevenness in charging of the photoreceptor, resulting in occurrence of horizontal streaks in the electrophotographic image due to uneven concentration.

Hereinafter, the uneven concentration causing horizontal streaks in the electrophotographic image is referred to as "banding". The electrophotographic image having horizontal streaks due to uneven concentration is referred to as "banding image".

In addition, the charging roller tends to be reduced in the diameter in recent years. This leads to a reduction in the contact area between the photoreceptor and the charging roller, resulting in enhancement of the occurrence of stick slip.

The present inventors have studied based on the above-described circumstances and have obtained a charging member that can sufficiently prevent banding images from occurring and have arrived at the present invention.

The present invention will now be described in detail using a charging member having a roller shape (hereinafter also referred to as "charging roller") according to the present invention.

The charging member according to the present invention includes an electro-conductive substrate and an electro-conductive resin layer serving as a surface layer. This conductive resin layer contains a binder, a plurality of bowl-shaped resin particles, and a plurality of hollow particles. The charging member has a surface having recesses due to openings of the bowl-shaped resin particles and protrusions due to edges of the openings of the bowl-shaped resin particles. The electro-conductive resin layer satisfies a positional relationship between the bowl-shaped resin particles and the hollow particles defined by the following requirement (1). In the electro-conductive resin layer, the bowl-shaped resin particles and the hollow particles satisfy the relationship defined by the following requirement (1).

Requirement (1): At least 4.0 hollow particles lie within the orthographic projection region of one bowl-shaped resin particle defined by orthographic projection of the bowl-shaped resin particle from the surface of the electro-conductive resin layer toward the depth direction and being between the outer wall surface of a shell forming the recess of the bowl-shaped resin particle and a plane $M_2$ parallel to the surface of the electro-conductive substrate and passing through the point $p_2$ at a distance of d, $b/(1+\sqrt{2})$ (μm) in the depth direction, from the point $p_1$ at the deepest position of the outer wall surface of the shell, where the symbol b in "$b/(1+\sqrt{2})$" represents the particle diameter (μm) of the bowl-shaped resin particle by spherical approximation.

Requirement (1) will be described.

FIG. 1 shows a partial cross-sectional view in the vicinity of the surface of a charging member according to the present invention. The direction from Z toward Z' in the drawing is the thickness direction of the charging member, and the "depth direction" in the present invention refers to the direction from Z toward Z'. When the charging member is a charging roller, the direction from Z toward Z' is a radial direction of the roller, and the "depth direction" is the direction from the outer surface of the charging roller toward the central portion. When the charging member is a charging roller, a plane parallel to the paper is a transverse plane orthogonal to the central axis of the changing roller.

In FIG. 1, symbol 1 denotes the edge of the opening of a bowl-shaped resin particle; symbol 2 denotes the recess due to the opening of the bowl-shaped resin particle; symbol 3 denotes an electro-conductive resin layer at least containing a binder, bowl-shaped resin particles, and hollow particles; and symbol 4 denotes the shell forming the recess of the bowl-shaped resin particle.

Symbol 5 denotes the "point $p_1$ at the deepest position of the outer wall surface of a shell" forming the recess of the bowl-shaped resin particle. This point is defined as "the point of the outer wall of the shell" at which the distance between the "conductive substrate" and the "outer wall surface of the shell of the bowl-shaped resin particle" is the shortest. When the charging member is a charging roller, the "point $p_1$ at the deepest position of the outer wall surface of a shell" is the "point of the outer wall of the shell" at which the length of the straight line binding between the "central axis of the charging roller" and the "outer wall surface of the shell of the bowl-shaped resin particle" is the shortest. In the description below, this "point $p_1$ at the deepest position of the outer wall surface of a shell" may be referred to as "upper reference point $p_1$".

Symbol 6 denotes the point $p_2$ (hereinafter may be referred to as "lower reference point $p_2$") at a distance d, $b/(1+\sqrt{2})$ (μm), in the depth direction, from the "upper reference point $p_r$".

Symbol 7 denotes the plane (hereinafter may be referred to as "lower reference plane $M_2$") passing through the lower reference point $p_2$ and parallel to the surface of the electro-conductive substrate.

When the charging member is a charging roller, the "lower reference plane $M_2$" can be determined by drawing a tangent line to a circle the center of which is the central axis of the charging roller at the "upper reference point $p_1$" and shifting the tangent line by the distance d in parallel to the direction of the electro-conductive substrate.

Two line segments 9 extending in the direction from Z toward Z' are boundary lines of a projected part (hereinafter may be referred to as "projected part of a bowl") when a bowl-shaped resin particle is orthographically projected on the surface of the electro-conductive substrate. The boundary lines of the projected part of a bowl cross the "lower reference plane $M_2$" denoted by symbol 7 at the points denoted by symbols 102 and 103.

Requirement (1) requires that at least 4.0 hollow particles are present within the orthographic projection region of one bowl-shaped resin particle defined by orthographic projection of the surface of the electro-conductive resin layer toward the depth direction and being between the "lower reference plane $M_2$" and the "outer wall surface of the shell". The number of the hollow particles present in this region can be 4.0 or more and 19.0 or less, in particular, 4.0 or more and 15.0 or less, from the viewpoint of expressing a damper effect. The reasons of this will be described in detail below.

In the following description, the space within the orthographic projection region between the "lower reference plane $M_2$" and the "outer wall surface of the shell" in requirement (1) may be referred to as "packing space just under a bowl".

In requirement (1), only the hollow particles being completely within the "packing space just under a bowl" are counted, and hollow particles partially protruding from the space are not counted. Specifically, for example, the counting is performed with an observation apparatus, such as a scanning electron microscope (SEM). In the measurement method described below, the numbers of hollow particles in the vicinities of 50 bowl-shaped particles are counted, and the arithmetic mean thereof is used as the number of hollow particles. The first decimal place of this number is displayed as the significant digit.

In this drawing, four hollow particles do not cross both two "boundary lines of the projected part of the bowl" and are present within the region between the "lower reference plane $M_2$" and the "outer wall surface of the shell" and between the two "boundary lines of the projected part of the bowl", and it therefore is obvious that four hollow particles are completely within the "packing space just under a bowl".

Figure 2A:
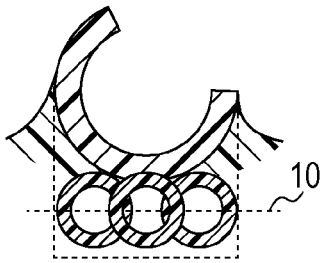
FIG. 2A is a partial cross-sectional view illustrating a positional relationship between a bowl-shaped resin particle and hollow particles of the present invention.
Figure 2B:
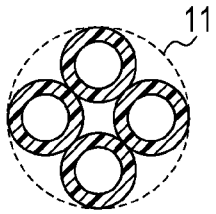
FIG. 2B is a partial cross-sectional view taken along the cutting plane indicated by symbol 10 in FIG. 2A.

FIGS. 2A and 2B are explanation diagrams showing a state satisfying the relationship defined by requirement (1) when four hollow particles are arrayed in a closest packing state in the "packing space just under a bowl". FIG. 2B is a cross-sectional view of this space taken along the cutting plane indicated by symbol 10 in FIG. 2A. FIG. 2B is a projection drawing of four hollow particles close-packed in the "packing space just under a bowl" having a diameter, b (μm), where symbol 11 denotes the outline of the "projected part of a bowl".

The particle diameter of four hollow particles close-packed in the "packing space just under a bowl" of the bowl-shaped resin particle having a diameter, b (μm), determined from this projection drawing is "$b/(1+\sqrt{2})$" (μm). That is, four or more hollow particles having a particle diameter of larger than "$b/(1+\sqrt{2})$" (μm) cannot be present within the "packing space just under a bowl" of the present invention. This description is on the assumption that all the hollow particles have the same particle diameter.

In the present invention, the hollow particles present lower than the lower reference plane $M_2$ may be in any packing state. It has been ascertained that the effect of absorbing vibration at the interface between the bowl-shaped particle present in the vicinity of the surface of the charging member and the hollow particles just under this bowl-shaped particle is dominant against the banding.

In the charging member of the present invention, the number of hollow particles being completely within the "packing space just under a bowl" of a bowl-shaped resin particle is 4.0 or more. The literature "Optimal Design Method for Multi Dynamic Absorber, Transactions of the Japan Society of Mechanical Engineers. C 62(601) 1996/09" describes a method for designing a multi dynamic absorber. When the vibration due to driving is transmitted to a bowl-shaped resin particle, the hollow particles arrayed in a state satisfying the relationship defined by requirement (1) probably play a role as dampers arranged in parallel. The presence of four or more dampers arranged in parallel realizes an enhanced effect of absorbing vibration as a dynamic absorber. The particle diameter of the hollow particle is determined by spherical approximation. The method thereof will be described below.

If the number of hollow particles being completely within the "packing space just under a bowl" of a bowl-shaped resin particle is 20 or more, since the hollow particles have a small particle diameter, the ability (vibration diffusing capacity) of the hollow particles as a damper is low. Accordingly, from the viewpoint of preventing banding, the number of hollow particles being completely within the "packing space just under a bowl" of a bowl-shaped resin particle can be 19.0 or less, such as 4.0 or more and 15.0 or less.

The particle diameter of the bowl-shaped resin particle and the particle diameter of the hollow particle will now be described. Regarding the particle diameter of the bowl-shaped resin particle, two diameters, a particle diameter (b) determined by spherical approximation of the bowl-shaped resin particle and a volume-average particle diameter (Mvb) of bowl-shaped resin particles, are defined. Regarding the particle diameter of the hollow particle, two diameters, a particle diameter (c) determined by spherical approximation of the hollow particle and a volume-average particle diameter (Mvc) of hollow particles, are defined. These physical property values are determined as described below.

An arbitrary bowl-shaped resin particle is selected from the surface of the electro-conductive substrate, and the bowl-shaped resin particle is sliced to give a plurality of cross-sections for one bowl-shaped resin particle. The bowl-shaped resin particle may be cut in any direction and can be cut in a direction perpendicular to the surface of the electro-conductive substrate. The diameter, b, of a bowl-shaped resin particle is determined by spherical approximation based on the plurality of cross-sections, the volume vb is calculated. The same procedure is performed for 50 bowl-shaped resin particles at arbitrary points on the surface of the electro-conductive substrate, and the volume-average particle diameter Mvb is determined from the resulting diameter b and volume vb.

In the region of a projected part formed by orthographic projection of a bowl-shaped resin particle onto the surface of the electro-conductive substrate, one hollow particle within the "packing space just under the bowl" surrounded by the outer wall surface of the shell and the lower reference plane $M_2$ is similarly sliced to give a plurality of cross-sections. Based on the resulting cross-sections, the diameter c of the hollow particle is determined by spherical approximation, and the volume vc is calculated. The same procedure is performed for 50 "packing spaces just under bowls" at arbitrary points on the surface of the electro-conductive substrate, and the volume-average particle diameter Mvc is determined from the resulting diameter c and volume vc.

In one bowl-shaped resin particle and one hollow particle for obtaining a plurality of cross-sections for performing spherical approximation, the slice width can be within a range of 1 to 50 nm, such as a range of 10 to 30 nm. Such a range is optimum from the viewpoint of trade-off between operating efficiency and accuracy of spherical approximation.

The particle diameter b can be 50 μm or more and 150 μm or less. A diameter b smaller than 50 μm provides a low effect of absorbing vibration, whereas a diameter b larger than 150 μm forms a large recess, resulting in readily occurrence of a line image. The volume-average particle diameter Mvb can be 60 μm or more and 140 μm or less. The reasons thereof are the same as those in the particle diameter b. The particle diameter c can be b/5 (μm) or more and $b/(1+\sqrt{2})$ (μm) or less. A diameter larger than $b/(1+\sqrt{2})$ (μm) has a risk of that the number of hollow particles within the "packing space just under a bowl" is three or less, whereas a diameter smaller than b/5 (μm) is too small to express the above-described effect as a damper, resulting in a low effect of absorbing vibration. The volume-average particle diameter Mvc can be 15 μm or more and 50 μm or less. Within this range, the above-described damper effect can be readily exhibited.

<Charging Roller>

Figure 3A:
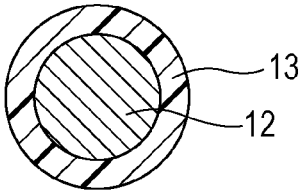
FIGS. 3A and 3B are cross-sectional views of (roller-shaped) charging members according to the present invention.
Figure 3B:
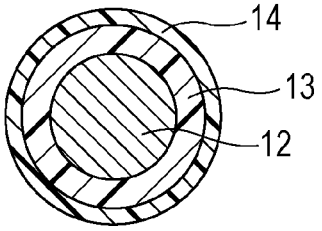

The charging roller according to the present invention will now be described in detail. FIGS. 3A and 3B schematically show cross-sections of an example of the charging roller according to the present invention. The charging roller shown in FIG. 3A includes an electro-conductive substrate 12 and an electro-conductive resin layer 13. The electro-conductive resin layer may have a two-layer structure consisting of conductive resin layers 13 and 14 as shown in FIG. 3B. The electro-conductive resin layer contains a binder and bowl-shaped resin particles.

The electro-conductive substrate and the electro-conductive resin layer or layers (for example, the electro-conductive resin layer 13 and the electro-conductive resin layer 14 shown in FIG. 3B) sequentially laminated on the electro-conductive substrate may be bonded with an adhesive. In this case, the adhesive can be conductive. The adhesive for providing conductivity can be a known conductive adhesive. The adhesive may be a thermosetting resin or a thermoplastic resin and can be a known resin, such as urethane, acrylic, polyester, polyether, and epoxy resins. The conducting agent for imparting conductivity to an adhesive can be appropriately selected from the electrically conductive fine particles that can be used for imparting conductivity to the electro-conductive resin layer described below. The electro-conductive agents may be used alone or in combination of two or more.

The charging roller according to the present invention can have a crown shape in which the thickness is reduced toward both ends in the longitudinal direction from the thickest portion at the center in the longitudinal direction, from the viewpoint of enhancing the following rotation with the photoreceptor at the central portion in the longitudinal direction. The crown quantity can be within a range of 30 to 200 μm, where the crown quantity is the average of differences between the outer diameter D2 of the roller member at the central portion in the longitudinal direction and the outer diameter D1 at the position apart from the central portion by 90 mm toward one end and between the outer diameter D2 and the outer diameter D3 at the position apart from the central portion by 90 mm toward the other end. The crown quantity can be calculated by the following expression (1):

$$\text{Crown quantity}=D2-(D1+D3)/2 \quad (1).$$

<Conductive Substrate>

The electro-conductive substrate used in the charging roller of the present invention is conductive and has a function of supporting the electro-conductive resin layer disposed thereon. Examples of the material of the electro-conductive substrate include metals, such as iron, copper, stainless steel, aluminum, and nickel, and alloys thereof.

<Conductive Resin Layer>

Figure 4A:
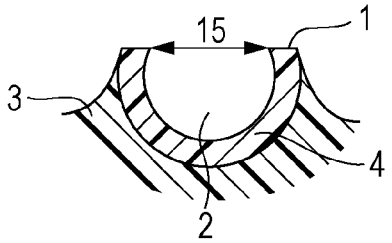
FIGS. 4A and 4B are partial cross-sectional views in the vicinity of the surface of a charging member according to the present invention.
Figure 4B:
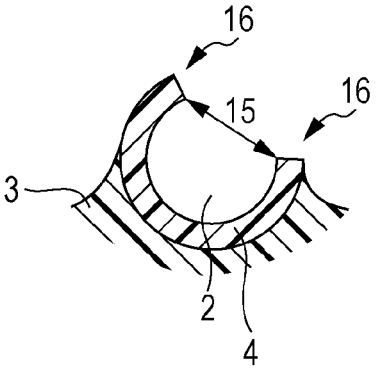
Figure 5:
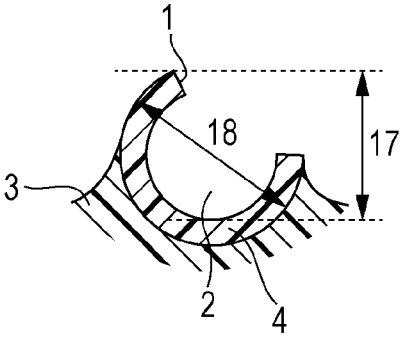
FIG. 5 is a partial cross-sectional view in the vicinity of the surface of a charging member according to the present invention.

FIGS. 4A and 4B are partial cross-sectional views in the vicinity of the surface of the electro-conductive resin layer of a charging roller. In a plurality of the bowl-shaped resin particles contained in the electro-conductive resin layer, a part of the bowl-shaped resin particles 4 are exposed to the surface of the roller. The surface of the charging roller has recesses 2 due to openings 15 of the bowl-shaped resin particles exposing to the surface and protrusions 16 due to the edges 1 of the openings of the bowl-shaped resin particles exposing to the surface. The distance 17, shown in FIG. 5, between the vertex of the protrusion 16 due to the edge of the opening of a bowl-shaped resin particle and the bottom of the recess 2 defined by the shell of the bowl-shaped resin particle can be 5 μm or more and 100 μm or less, in particular, 8 μm or more and 80 μm or less. Hereinafter, this distance may be referred to "height difference". When the distance 17 is within the above-mentioned range, the abutting pressure is more certainly mitigated. The ratio of the maximum diameter 18 of the bowl-shaped resin particle to the height difference 17, i.e., the value of [maximum diameter]/[height difference] of a resin particle, can be 0.8 or more and 3.0 or less. Within this range, the abutting pressure can be more certainly reduced.

Formation of the uneven surface profile can control the surface condition of the roller member, i.e., the surface condition of the electro-conductive resin layer, as follows: The ten-point average roughness (Rzjis) is 5 μm or more and 65 μm or less, in particular, 10 μm or more and 50 μm or less; the average interval (Sm) of the irregularity on the surface is 30 μm or more and 200 μm or less, in particular, 40 μm or more and 150 μm or less. Within these ranges, the abutting pressure can be more certainly reduced. The methods for measuring the ten-point average roughness (Rzjis) of the surface and the average interval (Sm) of the irregularity of the surface are described in detail below.

Figure 6A:
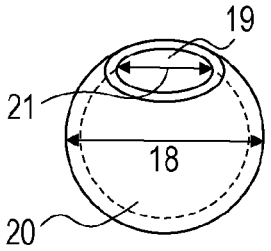
FIGS. 6A to 6E are explanation diagrams of shapes of bowl-shaped resin particles of the present invention.
Figure 6B:
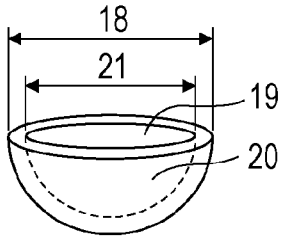
Figure 6C:
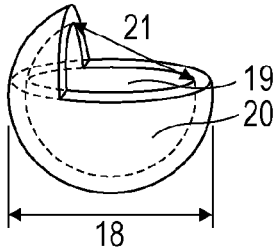
Figure 6D:
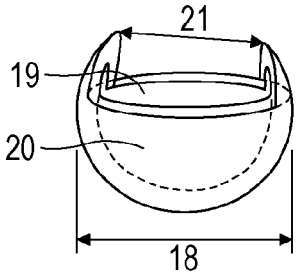
Figure 6E:
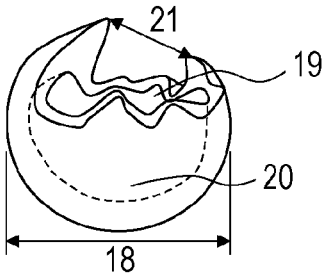

Examples of the bowl-shaped resin particle used in the present invention are shown in FIGS. 6A to 6E. In the present invention, the term "bowl-shaped" resin particle refers to a particle having a shape including an opening portion 19 and a roundish recess 20 defined by a shell. The opening portion may have a flat edge as shown in FIGS. 6A and 6B, or may have an irregular edge as shown in FIGS. 6C to 6E.

The bowl-shaped resin particle has a maximum diameter 18 of about 5 μm or more and 150 μm or less, in particular, 8 μm or more and 120 μm or less. The ratio of the maximum diameter 18 of a bowl-shaped resin particle to the minimum diameter 21 of the opening portion, i.e., the value of [maximum diameter]/[minimum diameter of opening portion] of the bowl-shaped resin particle can be 1.1 or more and 4.0 or less. Within this range, the abutting pressure can be more certainly reduced.

The shell of the bowl-shaped resin particle can have a thickness of 0.1 μm or more and 3 μm or less, in particular, 0.2 μm or more and 2 μm or less. The shell having a thickness within this range can elastically deform the edge more flexibly, and as a result, the abutting pressure can be more certainly mitigated. In addition, the maximum thickness of the shell can be at most three times, in particular, two times larger than the minimum thickness.

<Binder>

The binder contained in the electro-conductive resin layer of the present invention may be a known rubber or resin. Examples of the rubber include natural rubber, vulcanized natural rubber, and synthetic rubber. Examples of the synthetic rubber include ethylene propylene rubber, styrene butadiene rubber (SBR), silicone rubber, urethane rubber, isopropylene rubber (IR), butyl rubber, acrylonitrile butadiene rubber (NBR), chloroprene rubber (CR), acrylic rubber, epichlorohydrin rubber, and fluororubber. The resin can be, for example, a thermosetting resin or a thermoplastic resin, in particular, a fluororesin, polyamide resin, acrylic resin, polyurethane resin, acrylic urethane resin, silicone resin, or butyral resin. These binders may be used alone or in combination. Alternatively, copolymers prepared by copolymerizing the monomers that are raw materials of these binders can be used.

<Electrically Conductive Fine Particles>

The electro-conductive resin layer may contain a known electrically conductive fine particle for having conductivity. Examples of the electrically conductive fine particle include metal oxides, metal fine particles, and carbon black. These electrically conductive fine particles may be used alone or in combination of two or more thereof. The content of the electrically conductive fine particle in the electro-conductive resin layer is approximately 2 to 200 parts by mass, in particular, 5 to 100 parts by mass based on 100 parts by mass of the binder.

<Method for Forming Conductive Resin Layer>

An exemplary method for forming the electro-conductive resin layer will now be described. A coating layer (hereinafter referred to as "preliminary coating layer") dispersing hollow resin particles in a binder is produced on an electro-conductive substrate. The surface is then polished to partially scrape away the hollow resin particles into bowl-like shapes to form recesses due to the openings of the bowl-shaped resin particles and protrusions due to edges of the opening of the bowl-shaped resin particles. Hereinafter, the shape including these recesses and protrusions are referred to as "uneven surface profile due to openings of the bowl-shaped resin particles". Thus, an electro-conductive resin layer containing a binder, bowl-shaped resin particles, and hollow particles (hollow resin particles) is formed, and the surface is then irradiated with an electron beam to control the rate of reconstruction of the elastic deformation of the electro-conductive resin layer.

<Thermally Expandable Microcapsule>

The material for forming hollow resin particle can be a thermally expandable microcapsule. The thermally expandable microcapsule includes an internal material in the particle, and the internal material expands by being applied with heat into a hollow resin particle.

In the use of the thermally expandable microcapsule, a thermoplastic resin is required to be used as the binder. Examples of the thermoplastic resin include acrylonitrile resins, vinyl chloride resins, vinylidene chloride resins, methacrylic acid resins, styrene resins, urethane resins, amide resins, methacrylonitrile resins, acrylic acid resins, acrylate resins, and methacrylate resins. Among these resins, at least one thermoplastic resin selected from acrylonitrile resins, vinylidene chloride resins, and methacrylonitrile resins having low gas transmission properties and high impact resilience can be used. These thermoplastic resins may be used alone or in combination of two or more thereof. Alternatively, copolymers prepared by copolymerizing the monomers that are raw materials of these thermoplastic resins can be used.

The internal material of the thermoplastic microcapsule can be a material that changes to a gas at a temperature lower than the softening point of the thermoplastic resin and expands, and examples thereof include low boiling point liquids, such as propane, propylene, butene, n-butane, isobutane, n-pentane, and isopentane; and high boiling point liquids, such as n-hexane, isohexane, n-heptane, n-octane, isooctane, n-decane, and isodecane.

The thermally expandable microcapsule can be produced by a known method, i.e., a suspension polymerization, interfacial polymerization, interfacial precipitation, or drying-in-liquid method. For example, in the suspension polymerization method, a polymerizable monomer, a material to be encapsulated in the thermally expandable microcapsule, and a polymerization initiator are mixed, and the mixture is dispersed in an aqueous solvent containing a surfactant and a dispersion stabilizer, followed by suspension polymerization. In addition, a compound having a reactive group that reacts with the functional group of a polymerizable monomer or an organic filler can be added.

Examples of the polymerizable monomer include acrylonitrile, methacrylonitrile, α-chloracrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (methyl acrylate, ethyl acrylate, n-butyl acrylate, isobutyl acrylate, t-butyl acrylate, isobornyl acrylate, cyclohexyl acrylate, and benzyl acrylate), methacrylates (methyl methacylate, ethyl methacylate, n-butyl methacylate, isobutyl methacylate, t-butyl methacylate, isobornyl methacylate, cyclohexyl methacylate, and benzyl methacylate), styrene monomers, acrylic amide, substituted acrylic amide, methacrylic amide, methacryl amide, substituted methacrylic amide, butadiene, ϵ-caprolactam, polyether, and isocyanate. These polymerizable monomers may be used alone or in combination of two or more thereof.

The polymerization initiator can be an initiator soluble in a polymerizable monomer, and a known peroxide initiator or azo initiator, in particular, an azo initiator, can be used. Examples of the azo initiator include 2,2'-azobisisobutyronitrile, 1,1'-azobiscyclohexane-1-carbonitrile, and 2,2'-azobis-4-methoxy-2,4-dimethylvaleronitrile. Among them, in particular, 2,2'-azobisisobutyronitrile can be used. The polymerization initiator can be used in an amount of 0.01 to 5 parts by mass based on 100 parts by mass of the polymerizable monomer.

Examples of the surfactant include anionic surfactants, cationic surfactants, nonionic surfactants, amphoteric surfactants, and polymer dispersing agents. The surfactant can be used in an amount of 0.01 to 10 parts by mass based on 100 parts by mass of the polymerizable monomer.

Examples of the dispersion stabilizer include organic fine particles (such as polystyrene fine particles, polymethyl methacrylate fine particles, polyacrylic acid fine particles, and polyepoxide fine particles), silica (such as colloidal silica), calcium carbonate, calcium phosphate, aluminum hydroxide, barium carbonate, and magnesium hydroxide. The dispersion stabilizer can be used in an amount of 0.01 to 20 parts by mass based on 100 parts by mass of the polymerizable monomer.

The suspension polymerization can be performed using a pressure resistant container in an airtight condition. Raw materials for polymerization may be suspended with, for example, a disperser, and the suspension may be transferred into a pressure resistant container and be suspension-polymerized therein. Alternatively, the raw materials may be suspended in a pressure resistant container. The polymerization temperature can be 50° C. to 120° C. Although the polymerization may be performed under an atmospheric pressure, in order to prevent vaporization of the material encapsulated in the thermally expandable microcapsule, the polymerization may be performed under increased pressure (under a pressure of 0.1 to 1 MPa higher than the atmospheric pressure). After completion of polymerization, solid-liquid separation and rinsing may be performed by centrifugation or filtration. In the case of performing solid-liquid separation or rinsing, subsequently, drying or pulverization may be performed at a temperature lower than the softening temperature of the resin constituting the thermally expandable microcapsule. The drying and pulverization can be performed by known methods, and a flash dryer, a fair wind dryer, and a nauta mixer can be used. The drying and pulverization can be simultaneously performed with a drying pulverizer. The surfactant and the dispersion stabilizer can be removed by repeating rinsing and filtration after the production.

In the present invention, the bowl-shaped resin particles and the hollow particles can be formed using thermally expandable microcapsules. Regarding the bowl-shaped resin particles, thermally expandable microcapsules are dispersed in an electro-conductive resin layer, followed by heating to generate hollow particles. The hollow particles are partially machined by polishing described below to form bowl-shaped resin particles.

Figure 12:
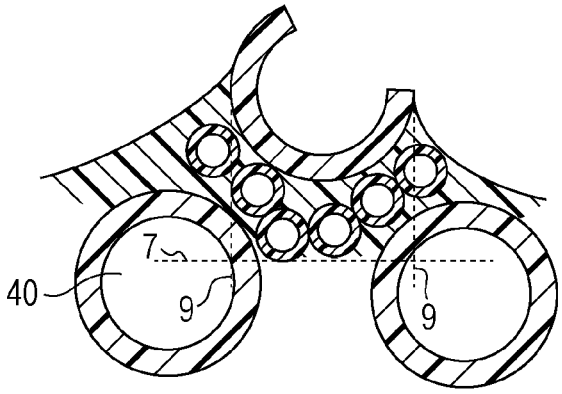
FIG. 12 is an explanation diagram of an embodiment in the vicinity of an electro-conductive resin layer produced by a method using two types of capsule particles.

The method for arranging the hollow particles in the state defined in requirement (1) of the present invention will be described. In the present invention, hollow particles can be arranged in a state satisfying the relationship defined by requirement (1) of the present invention by utilizing two types of thermally expandable microcapsules having different particle diameters after expansion. The particle diameter after expansion can be controlled by, for example, controlling the particle diameter of the thermally expandable microcapsule before expansion. In this method, if the structural components (binder and internal material) of the thermally expandable microcapsule are constant, the particle diameter after expansion (diameter of hollow particle) can be controlled by controlling the particle diameter of the thermally expandable microcapsule. Hollow particles having large diameters become the bowl-shaped resin particles, and hollow particles having small diameters are arranged in a state satisfying the relationship defined by requirement (1) of the present invention. In this case, a hollow particle having a large diameter corresponds to a thermally expandable microcapsule having a large diameter, whereas a hollow particle having a small diameter corresponds to a thermally expandable microcapsule having a small diameter. Accordingly, in this method, as shown in FIG. 12, small hollow particles lie under bowl-shaped particles, and further therebelow, small hollow particles lie around large hollow particles.

The hollow particles can be arranged in a state that satisfies the relationship defined by requirement (1) of the present invention by, for example, coating the surface of a thermally expandable microcapsule having a large diameter with thermally expandable microcapsules having small diameters. The coating can be performed by attaching particles having small particles to particles having large particles using a hybridizer to coat the particles having large particles with the particles having small particles. For example, coating treatment can be performed using a hybridization system manufactured by Nara Machinery Co., Ltd.

Alternatively, thermally expandable microcapsules having small diameters may be attached to thermally expandable microcapsules having large diameters with a silane coupling agent or a titanate coupling agent. Dry stirring can be used as the attaching method. In the dry stirring, thermally expandable microcapsules having large diameters and thermally expandable microcapsules having small diameters are put in a high-speed mixer, such as a Henschel, ribbon, or V-type mixer, and an aqueous solution or organic solvent containing a coupling agent is dropwise added thereto.

In the arrangement of these hollow particles, the particle diameters of the hollow particles may be controlled by appropriately controlling the binder and the internal material of the thermally expandable microcapsules. The particle diameter after expansion can be controlled by regulating the Tg of the binder using an acrylate and/or methacrylate monomer. The particle diameter can be also controlled by controlling the content and the boiling point of the internal material.

<Preliminary Coating Layer and Method for Forming Conductive Resin Layer>

A method for forming the preliminary coating layer will now be described. The preliminary coating layer can be formed by, for example, forming a layer of an electro-conductive resin composition on an electro-conductive substrate by an application method, such as electrostatic spraying, dipping, or roll coating, and hardening the layer by, for example, drying, heating, or cross-linking. Alternatively, a film of an electro-conductive resin composition having a predetermined thickness is hardened into a sheet-shaped or tube-shaped layer, and the layer may be attached to or coat the electro-conductive substrate. The preliminary coating layer can also be formed by hardening and molding an electro-conductive resin composition in a mold with the electro-conductive substrate therein. In particular, when the binder is rubber, the preliminary coating layer can be produced by integrally extruding the electro-conductive substrate and an unvulcanized rubber composition with an extruder equipped with a crosshead. The crosshead is an extrusion die that is used for forming a coating layer of an electric wire or a wire by being disposed at the tip of the cylinder of an extruder.

After drying, hardening, or cross-linking of the resulting preliminary coating layer, the surface of the preliminary coating layer is polished to partially scrape away the hollow resin particles to form bowl shapes. As a result, bowl-shaped resin particles are fixed so as to expose to the surface of the electro-conductive resin layer, and recesses due to the openings of the bowl-shaped resin particles and protrusions due to the edges of the openings of the bowl-shaped resin particles are formed. The polishing can be performed by cylinder polishing or tape polishing. Examples of the cylinder polishing machine include traverse type NC cylinder polishing machines and plunge cut type NC cylinder polishing machines.

The hollow resin particle encapsulates a gas therein and thereby has high impact resilience. Accordingly, the binder of the electro-conductive resin layer can be selected from rubbers and resins having relatively low impact resilience and a low stretch. Consequently, a state that the electro-conductive resin layer can be readily polished and that hollow resin particles are hardly polished can be achieved. When the electro-conductive resin layer in such a state is polished, hollow resin particles are partially scraped away into bowl-shaped resin particles. As a result, openings of the bowl-shaped resin particles can be formed on the surface of the electro-conductive resin layer. This method utilizes the difference in abradability between the hollow resin particles and the preliminary coating layer and thereby forms recesses due to openings and protrusions due to the edges of the openings. Accordingly, the binder contained in the electro-conductive elastic layer can be rubber. Specifically, acrylonitrile butadiene rubber, styrene butadiene rubber, or butadiene rubber having low impact resilience and low stretch can be used.

Furthermore, the hollow particle can contain a resin having a polar group, from the viewpoint of that the shell has low gas transmission properties and high impact resilience. Examples of such a resin include resins having units represented by Formula (1). Furthermore, from the viewpoint of easiness in control of polishing of the hollow particle, the resin can have both a unit represented by Formula (1) and a unit represented by Formula (5).

(1)

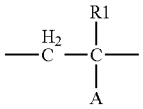

where A represents at least one selected from those represented by Formula (2), (3), or (4):

(2)

(3)

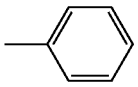

(4)

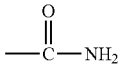

and R1 represents a hydrogen atom or an alkyl group having 1 to 4 carbon atoms.

(5)

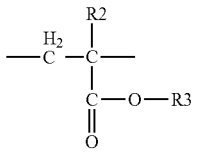

where R2 represents a hydrogen atom or an alkyl group having 1 to 4 carbon atoms; R3 represents a hydrogen atom or an alkyl group having 1 to 10 carbon atoms; and R2 and R3 may have the same or different structures.

<Polishing Method>

Figure 7A:
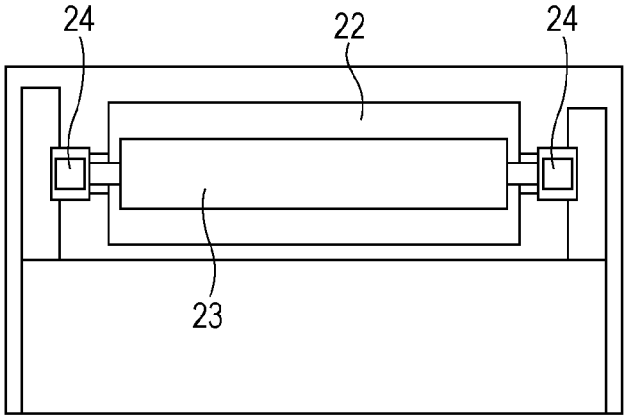
FIGS. 7A and 7B are explanation diagrams of a plunge type polishing machine.
Figure 7B:
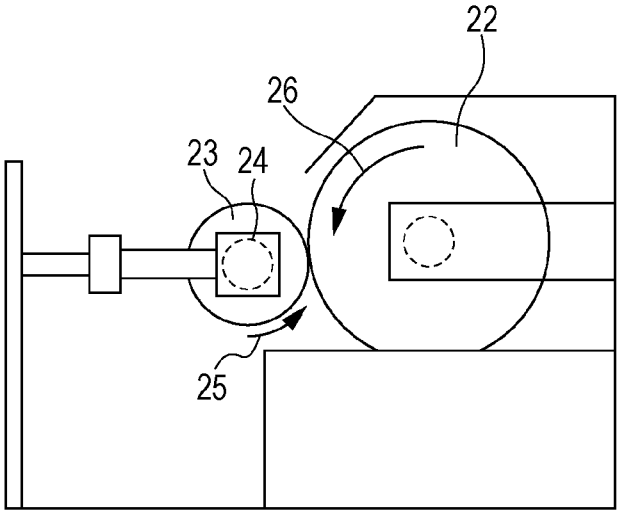

The polishing method may be performed by cylinder polishing or tape polishing. Since a significant difference in abradability is needed between the materials, a higher polishing rate can be employed. In this viewpoint, cylinder polishing can be performed. The cylinder polishing can be of a plunge cut type from the viewpoint of capable of also polishing the longitudinal direction of an electro-conductive roller to reduce the time for polishing. FIGS. 7A and 7B are explanation diagrams of a plunge cut type polishing machine. FIG. 7A is a front view and FIG. 7B is a side view of the plunge cut type polishing machine. The spark-out step (polishing step at an invasion speed of 0 mm/min), which has been performed from the viewpoint of providing a uniformly polished surface, may be performed for a time as short as possible or may not be performed. As an example, the rotation speed of plunge cut type cylinder polishing stone can be 1000 to 4000 rpm, in particular, 2000 to 4000 rpm. The invasion speed into the preliminary coating layer can be 5 to 30 mm/min, in particular, 10 to 30 mm/min. At the last of the invasion step, the polished surface may be subjected to a conditioning step, for example, at an invasion speed of 0.1 to 0.2 mm/min within 2 sec. The spark-out step (polishing step at an invasion speed of 0 mm/min) may be performed for 3 sec or less. The rotation speed can be 50 rpm or more and 500 rpm or less, in particular, 200 rpm or more. In these conditions, uneven surface profile due to openings of the bowl-shaped resin particles can be more readily formed on the surface of the preliminary coating layer to produce an electro-conductive roller including an electro-conductive resin layer.

<Surface Treatment>

Figure 8:
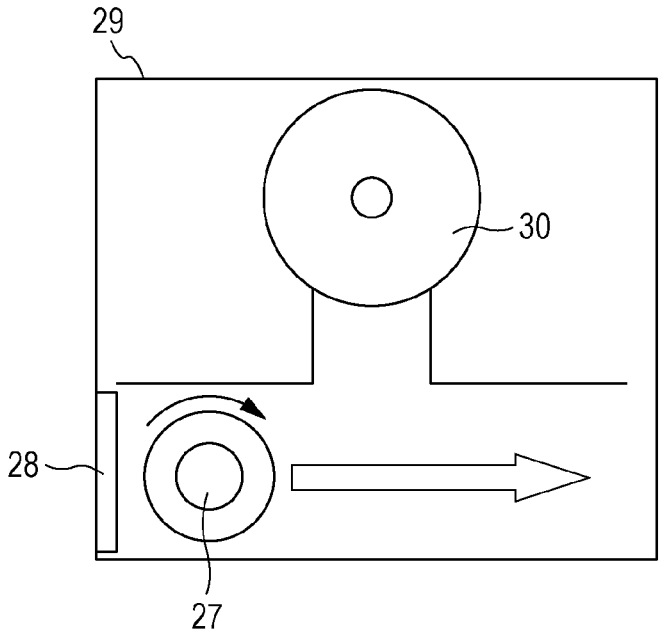
FIG. 8 is an explanation diagram of an electron beam irradiator.

After formation of a layer by polishing the electro-conductive resin layer, the surface may be subjected to surface treatment, such as UV irradiation or electron beam irradiation. FIG. 8 is an explanation diagram of illustrating an example of the method for irradiating a roller-shaped member provided with an electro-conductive resin layer with an electron beam. The member 27 provided with an electro-conductive resin layer is set to a rotary tool (not shown) and is transferred into the electron beam irradiator 29 from the input port 28 having a shutter door. Subsequently, the shutter door is closed, and the electron beam irradiator is purged with nitrogen until the oxygen concentration in the internal atmosphere is reduced to 100 ppm or less. The member 27 is then irradiated with an electron beam from the electron beam generating part 30. The electron beam generating part 30 includes an electron beam-accelerating vacuum chamber and a filament cathode. The cathode emits thermoelectrons from its surface by being heated. The emitted thermoelectrons are accelerated by an accelerating voltage and are then emitted as an electron beam. The number (exposure dose) of the electron beams to be emitted from the cathode can be controlled by changing the shape of the filament or the heating temperature of the filament.

The dose of the electron beam in the electron beam irradiation is defined by the following expression (2):

$$D=(K\cdot I)/V \quad (2)$$

where D represents the dose (kGy), K represents the device constant, I represents the electronic current (mA), and V represents the processing speed (m/min). The device constant K is a constant representing the efficiency of an individual device and is an indicator of device performance. The device constant K can be determined by measuring doses by varying the electronic current and the processing speed under a constant accelerating voltage. The dose of electron beams is measured by attaching a dose-measuring film to the surface of the roller, actually irradiating the film by the electron beam irradiator, and measuring the dose of electron beams on the dose-measuring film with a film dosemeter. The dose-measuring film and the film dosemeter are, for example, FWT-60 and FWT-92D, respectively, (both manufactured by Far West Technology Inc.). The dose of electron beams in the present invention can be 30 kGy or more from the viewpoint of the effect of surface modification and is 3000 kGy or less from the viewpoint of preventing excess cross-linking and collapse of the surface.

<Other Components in Conductive Resin Layer>

The electro-conductive resin layer of the charging member may contain an ion conducting agent and insulating particles, in addition to the electrically conductive fine particles.

Examples of the ion conducting agent include perchlorates such as $LiClO_4$ and $NaClO_4$, and quaternary ammonium salts. These agents can be used alone or in combination of two or more thereof.

Examples of materials of the insulating particles include zinc oxide, tin oxide, indium oxide, titanium oxides (such as titanium dioxide and titanium monoxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, hydrotalcite, dolomite, talc, kaolin clay, mica, aluminum hydroxide, magnesium hydroxide, zeolite, wollastonite, diatom earth, glass beads, bentonite, montmorillonite, hollow glass, organic metal compounds, and organic metal salts.

<Volume Resistivity of Conductive Resin Layer>

The electro-conductive resin layer can have a volume resistivity of about $1\times10^2$ Ω·cm or more and $1\times10^{16}$ Ω·cm or less in an environment of a temperature of 23° C. and a relative humidity of 50%. This range allows appropriate charging of the electrophotographic photoreceptor with more easiness by discharging.

The volume resistivity of an electro-conductive resin layer is determined as follows. The electro-conductive resin layer is cut out from a charging member in a rectangular shape of approximately 5 mm in length, 5 mm in width, and 1 mm in thickness. A metal is deposited on both surfaces of the electro-conductive resin layer to produce an electrode and a guard electrode as a sample for measurement. If the electro-conductive resin layer is a thin film and cannot be cut out, an electro-conductive elastic composition for forming an electro-conductive resin layer is applied onto an aluminum sheet to form a coating film, and a metal is deposited on the coating film to prepare a sample for measurement. A voltage of 200 V is applied to the resulting sample for measurement with a microammeter (trade name: ADVANTEST R8340A ULTRAHIGH RESISTANCE METER, manufactured by Advantest Corporation). The current after 30 sec is measured, and the volume resistivity is calculated from the thickness and the electrode area. The volume resistivity of an electro-conductive resin layer can be adjusted with the above-described electrically conductive fine particles and the ion conducting agent. The electrically conductive fine particles have an average particle diameter of about 0.01 to 0.9 μm, in particular, 0.01 to 0.5 μm. The content of the electrically conductive fine particles in the electro-conductive resin layer can be about 2 to 80 parts by mass, in particular, 20 to 60 parts by mass, based on 100 parts by mass of the binder.

<Electrophotographic Apparatus>

Figure 9:
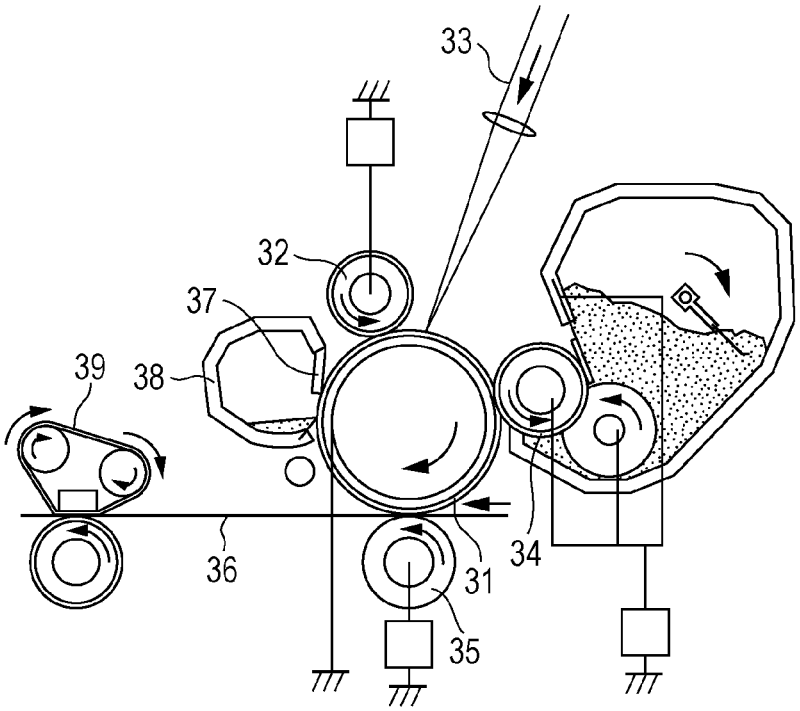
FIG. 9 is an explanation diagram of an embodiment of an electrophotographic apparatus according to the present invention.

The electrophotographic apparatus according to the present invention is characterized in that the electrophotographic apparatus at least includes the charging member of the present invention, an exposure device, and a developing device. FIG. 9 schematically illustrates the structure of an example of the electrophotographic apparatus according to the present invention. This electrophotographic apparatus is composed of an electrophotographic photoreceptor, a charging device for the electrophotographic photoreceptor, a latent image forming device for performing exposure, a developing device, a transfer device, a cleaning device for untransferred toner on the electrophotographic photoreceptor, a fixing device, and other components. The electrophotographic photoreceptor 31 is of a rotating drum type having a photosensitive layer on the electro-conductive substrate. The electrophotographic photoreceptor is rotationally driven in the direction shown by the arrow at a predetermined circumferential velocity (process speed). The charging device includes a contact-type charging roller 32 in a contact configuration by abutting against the electrophotographic photoreceptor 31 at a predetermined pressing force. The charging roller 32 rotates by following rotation with the rotation of the electrophotographic photoreceptor 31 and is applied with a predetermined DC voltage by a charging power supply and thereby charges the electrophotographic photoreceptor to a predetermined potential. The latent image forming device for forming electrostatic latent images on the electrophotographic photoreceptor 31 is an exposure device such as a laser beam scanner. An electrostatic latent image is formed by irradiating the uniformly charged electrophotographic photoreceptor 31 with exposure light 33 corresponding to image information.

The developing device includes a developing sleeve or developing roller 34 arranged in proximity to or in contact with the electrophotographic photoreceptor 31. A toner image is formed by developing an electrostatic latent image through reverse development of toner electrostatically treated to the same polarity as the charge polarity of the electrophotographic photoreceptor. The transfer device includes a contact type transfer roller 35. The toner image is transferred form the electrophotographic photoreceptor to a transfer material such as plain paper. The transfer material 36 is transferred to a sheet feeding system having a conveyance member. The cleaning device includes a blade type cleaning member 37 and a collecting container 38 and mechanically scrapes the untransferred toner remaining on the electrophotographic photoreceptor 31 to collect the toner after the transcription. Here, the cleaning device may be omitted by employing a system simultaneously performing developing and cleaning to collect the untransferred toner with a developing device. The fixing member 39 is of a heated roll and fixes the transferred toner image to the transfer material 36 and discharges the image to the outside of the device.

<Process Cartridge>

Figure 10:
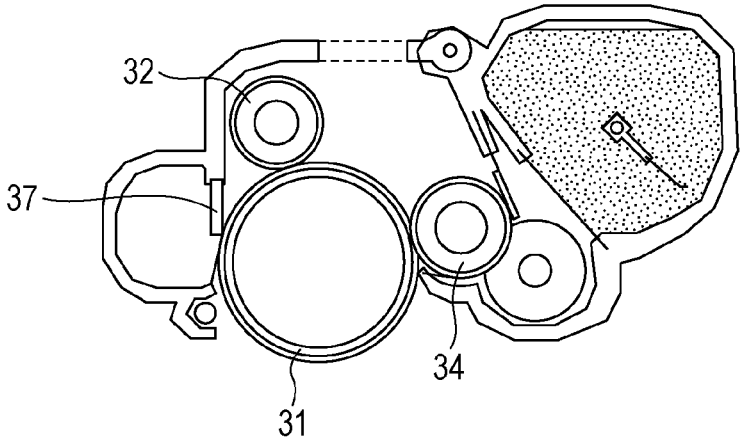
FIG. 10 is an explanation diagram of an embodiment of a process cartridge according to the present invention.

The process cartridge according to the present invention is characterized in that the charging member of the present invention is integrated with at least a body to be electrified and that the process cartridge is detachably attached to the main body of an electrophotographic apparatus. FIG. 10 schematically illustrates an example of the process cartridge. The process cartridge includes the integrated electrophotographic photoreceptor 31 as the body to be electrified, a charging roller 32, a developing roller 34, a cleaning member 37, and other components and is detachably attached to the electrophotographic apparatus. The charging member of the present invention can also be used as the above-mentioned developing roller.

An embodiment of the present invention can provide a charging member that can sufficiently prevent occurrence of banding images due to an increase in the process speed of the electrophotographic apparatus and a decrease in the diameter of the charging member. Another embodiment of the present invention can provide a process cartridge and an electrophotographic apparatus facilitating formation of a high-quality electrophotographic image.

EXAMPLES

The present invention will now be described in further detail by specific Production Examples and Examples.

Methods for measuring each physical property according to the present invention will be shown below.

1. Measurement of Volume-Average Particle Diameter of Capsule Particle

The volume-average particle diameter of a powder is measured with a laser diffraction particle size distribution analyzer (trade name: Coulter LS 230, manufactured by Beckman Coulter, Inc.). The measurement uses water module and uses pure water as a measurement solvent. The inside of the measuring system of the particle size distribution analyzer is rinsed with pure water for about 5 min, and 10 to 25 mg of sodium sulfite is added, as an antifoaming agent, to the inside of the measuring system, followed by execution of a background function.

Subsequently, three or four drops of a surfactant are added to 50 mL of pure water, and 1 to 25 mg of a measurement sample is further added thereto. The aqueous solution suspending the sample is subjected to dispersion with an ultrasonic distributor for 1 to 3 min to prepare a test sample solution. The test sample solution is gradually added to the inside of the measuring apparatus, and the concentration of the test sample in the measuring system is adjusted such that the PIDS on the display of the apparatus is 45% or more and 55% or less, followed by measurement. The volume-average particle diameter is calculated from the resulting volume distribution.

2. Measurement of Diameter b and Volume-Average Particle Diameter Mvb

From the surface of the charging roller, 50 bowl-shaped resin particles are arbitrarily selected. Each bowl-shaped resin particle is photographed for each section prepared by cutting the bowl-shaped resin particle by a thickness of 20 nm for every section with a focused ion beam (trade name: FB-2000C, manufactured by Hitachi, Ltd.). Through spherical approximation of these sectional images, the diameter b and volume vb are determined. The diameter b and the volume vb are calculated for each of the selected 50 bowl-shaped resin particles. From these values, the volume-average particle diameter Mvb of 50 bowl-shaped resin particles is calculated.

3. Measurement of Particle Diameter c and Volume-Average Particle Diameter Mvc

Regarding the 50 bowl-shaped resin particles measured for the diameter b and the volume-average particle diameter Mvb, the "packing space just under each bowl" is photographed for each section prepared by cutting the packing space by a thickness of 20 nm from the "upper reference point $p_1$" to the "lower reference point $p_2$" with planes parallel to the plane of the projected part formed by orthographic projection of each bowl-shaped resin particle onto the surface of the electro-conductive substrate using a focused ion beam (trade name: FB-2000C, manufactured by Hitachi, Ltd.). From these sectional images, each hollow particle being within the "packing space just under a bowl" is spherically approximated, and the diameter thereof is determined as the particle diameter c of the hollow particle through spherical approximation. The diameters c and the volumes vc of all the hollow particles being within the "packing space just under a bowl" of each bowl-shaped resin particle are calculated. From these values, the volume-average particle diameter Mvc of the hollow particles being within the "packing space just under a bowl" of each of the 50 bowl-shaped resin particles is calculated.

4. Number of Hollow Particles

The hollow particles used for measuring the diameter c and the volume-average particle diameter Mvc are those being completely within the "packing space just under a bowl" and therefore obviously satisfy requirement (1) of the present invention. Accordingly, the average number of the hollow particles being in the "packing space just under a bowl" of each of the 50 bowl-shaped resin particles is defined as the "number of hollow particles".

5. Measurement of Surface Roughness Rzjis

The surface roughness is measured in accordance with JIS B 0601-1994 with a surface roughness measuring device (trade name: SE-3500, manufactured by Kosaka Laboratory Ltd.). The surface roughness Rzjis is the average of those measured at six points randomly selected on the surface of the charging roller. The cut-off value is 0.8 mm, and the evaluation length is 8 mm.

The following Production Examples 1 to 33 are production examples of capsule particles 1 to 33.

Production Example 1

An aqueous mixture of 4000 parts by mass of deionized water, 2 parts by mass of colloidal silica serving as a dispersion stabilizer, and 0.15 parts by mass of polyvinylpyrrolidone was prepared. Separately, an oil mixture of polymerizable monomers (50 parts by mass of acrylonitrile, 45 parts by mass of methacrylonitrile, and 5 parts by mass of methyl methacrylate), an internal material (15.0 parts by mass of n-hexane), and a polymerization initiator (0.75 parts by mass of dicumyl peroxide) was prepared. The oil mixture was added to the aqueous mixture, and 0.4 parts by mass of sodium hydroxide was further added to the resulting mixture to prepare a dispersion.

The resulting dispersion was stirred with a homogenizer for 3 min and was fed in a polymerization reactor purged with nitrogen, followed by reaction with stirring at 50 rpm at 60° C. for 20 hr to prepare a reaction product. The reaction product was repeatedly subjected to filtration and rinsing and was then dried at 80° C. for 5 hr to produce capsule particles.

The resulting capsule particles were sieved with a dry air classifier (Classiel N-20: manufactured by Seishin Enterprise Co., Ltd.) to prepare capsule particle 1. The classification was performed at a rotation speed of classification rotor of 400 rpm. The volume-average particle diameter of the resulting capsule particles is shown in Table 1.

Production Examples 2 to 8

Capsule particles 2 to 8 were produced as in Production Example 1 except that the rotation speed of the classification rotor was adjusted to 500 rpm, 600 rpm, 750 rpm, 800 rpm, 820 rpm, 900 rpm, or 1000 rpm. The volume-average particle diameters of the resulting capsule particles are shown in Table 1.

Production Example 9

Capsule particle 9 was produced as in Production Example 1 except that 5 parts by mass of colloidal silica was used, the rotation speed of the homogenizer was 100 rpm, and the rotation speed of the classification rotor was 1000 rpm. The volume-average particle diameter of the resulting capsule particle is shown in Table 1.

Production Examples 10 to 17

Capsule particles 10 to 17 were produced as in Production Example 9 except that the rotation speed of the classification rotor was adjusted to 1050 rpm, 1120 rpm, 1150 rpm, 1200 rpm, 1270 rpm, 1300 rpm, 1350 rpm, or 1380 rpm. The volume-average particle diameters of the resulting capsule particles are shown in Table 1.

Production Example 18

Capsule particle 18 was produced as in Production Example 1 except that 9 parts by mass of colloidal silica was used, the rotation speed of the homogenizer was 200 rpm, and the rotation speed of the classification rotor was 1380 rpm. The volume-average particle diameter of the resulting capsule particle is shown in Table 1.

Production Examples 19 to 25

Capsule particles 19 to 25 were produced as in Production Example 18 except that the rotation speed of the classification rotor was adjusted to 1400 rpm, 1430 rpm, 1470 rpm, 1500 rpm, 1580 rpm, 1600 rpm, or 1650 rpm. The volume-average particle diameters of the resulting capsule particles are shown in Table 1.

Production Example 26

Capsule particle 26 was produced as in Production Example 1 except that 12 parts by mass of colloidal silica was used, the rotation speed of the homogenizer was 1000 rpm, and the rotation speed of the classification rotor was 1650 rpm. The volume-average particle diameter of the resulting capsule particle is shown in Table 1.

Production Examples 27 to 33

Capsule particles 27 to 33 were produced as in Production Example 26 except that the rotation speed of the classification rotor was adjusted to 1680 rpm, 1720 rpm, 1760 rpm, 1780 rpm, 1830 rpm, 1900 rpm, or 1950 rpm. The volume-average particle diameters of the resulting capsule particles are shown in Table 1.

TABLE 1

| Capsule particle No. | Volume-average particle diameter (μm) |
|---|---|
| Capsule particle 1 | 83.0 |
| Capsule particle 2 | 70.0 |
| Capsule particle 3 | 62.0 |
| Capsule particle 4 | 50.0 |
| Capsule particle 5 | 43.0 |
| Capsule particle 6 | 42.0 |
| Capsule particle 7 | 36.0 |
| Capsule particle 8 | 33.5 |
| Capsule particle 9 | 32.0 |
| Capsule particle 10 | 29.0 |
| Capsule particle 11 | 26.0 |
| Capsule particle 12 | 24.0 |
| Capsule particle 13 | 22.0 |
| Capsule particle 14 | 20.0 |
| Capsule particle 15 | 17.0 |
| Capsule particle 16 | 15.5 |
| Capsule particle 17 | 14.2 |
| Capsule particle 18 | 13.5 |
| Capsule particle 19 | 13.0 |
| Capsule particle 20 | 12.5 |
| Capsule particle 21 | 11.0 |
| Capsule particle 22 | 10.0 |
| Capsule particle 23 | 8.5 |
| Capsule particle 24 | 7.5 |
| Capsule particle 25 | 6.6 |
| Capsule particle 26 | 6.5 |
| Capsule particle 27 | 5.2 |
| Capsule particle 28 | 5.0 |
| Capsule particle 29 | 4.5 |
| Capsule particle 30 | 4.2 |
| Capsule particle 31 | 3.0 |
| Capsule particle 32 | 2.5 |
| Capsule particle 33 | 2.3 |

Example 1

1. Conductive substrate

A thermosetting resin containing 10% by mass of carbon black was applied onto a stainless steel cylindrical substrate having a diameter of 6 mm and a length of 252.5 mm, followed by drying to prepare an electro-conductive substrate.

2. Pretreatment of capsule particle

A capsule particle mixture was prepared by mixing capsule particle A (100 parts by mass of capsule particle 15) and capsule particle B (40 parts by mass of capsule particle 24) with a hybridizer (trade name: Hybridization System, manufactured by Nara Machinery Co., Ltd.). Subsequently, 100 parts by mass of the capsule particle mixture was added to 100 parts by mass of acrylonitrile butadiene rubber (NBR) (trade name: N230SV, manufactured by JSR Corporation), and the mixture was kneaded with an enclosed mixer for 15 min to produce "capsule particle master batch".

3. Production of conductive rubber composition

To 100 parts by mass of acrylonitrile butadiene rubber (NBR) (trade name: N230SV, manufactured by JSR Corporation) were added 45 parts by mass of carbon black (trade name: Tokablack #7360SB, manufactured by Tokai Carbon Co., Ltd.), 5 parts by mass of zinc oxide (trade name: Zinc Oxide type 2, manufactured by Sakai Chemical Industry Co., Ltd.), and 20 parts by mass of calcium carbonate (trade name: Super #1700, manufactured by Maruo Calcium Co., Ltd.). The mixture was kneaded with an enclosed mixer adjusted to 50° C. for 15 min. Subsequently, 20 parts by mass of the capsule particle master batch, 1 part by mass of sulfur, 0.5 parts by mass of dipentamethylenethiuramtetrasulfide (TRA) (trade name: Nocceler TRA, manufactured by Ouchi Shinko Chemical Industrial Co., Ltd.), and 0.5 parts by mass of 2-mercaptobenzothiazole (trade name: Nocceler M-P, manufactured by Ouchi Shinko Chemical Industrial Co., Ltd.) were added to the kneaded mixture. The resulting mixture was kneaded with a two-roll mill cooled to 25° C. for 10 min to prepare an electro-conductive rubber composition.

4. Formation of conductive resin layer

Figure 11:
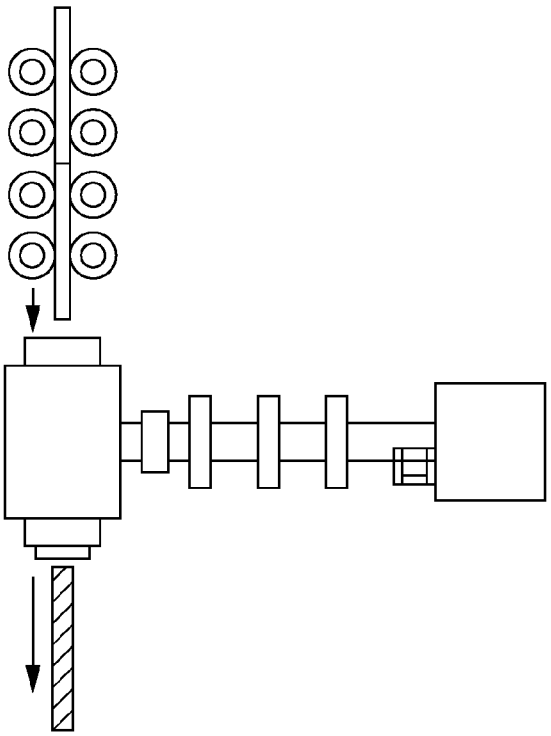
FIG. 11 is an explanation diagram of a crosshead extruder.

The cylindrical peripheral surface of the electro-conductive substrate was coated by the electro-conductive rubber composition with an extrusion molding machine equipped with the crosshead shown in FIG. 11 using the electro-conductive substrate as the central axis. The thickness of the coated conductive rubber composition was adjusted to 1.0 mm. The roller after the extrusion was heated in an air-heating furnace at 160° C. for 1 hr to vulcanize the electro-conductive rubber composition. The ends of the rubber layer were then removed to adjust the length to 224.2 mm. The electro-conductive rubber composition was further subjected to secondary vulcanization at 160° C. for 1 hr to produce a roller having a preliminary coating layer having a thickness of 3.5 mm. The outer peripheral surface of the resulting roller was polished with a plunge cut type cylinder polishing machine. A vitrified grinding stone was used as polishing abrasive grain. The abrasive grain was green silicon carbide (GC) having a grain size of 100 mesh. The rotation speed of the roller was 350 rpm, and the rotation speed of the polishing grinding stone was 2050 rpm. The polishing was performed at a cutting speed of 20 mm/min and a spark-out time (the time at cutting of 0 mm) of 0 sec to produce an electro-conductive roller having an electro-conductive resin layer. The thickness of the electro-conductive resin layer was adjusted to 1.3 mm. This roller had a crown quantity of 120 μm.

5. Electron beam irradiation of conductive resin layer

The electro-conductive roller was irradiated with an electron beam under the following conditions to prepare roller member 1. The electron beam was irradiated with an electron beam irradiator (trade name: Low energy electron beam irradiation source, EB-ENGINE, manufactured by Hamamatsu Photonics K.K.). The atmospheric oxygen concentration was reduced to 500 ppm or less by nitrogen gas purge. The roller member was irradiated with an electron beam by being transferred at a processing speed of 10 mm/s and being rotated at 300 rpm using the electro-conductive substrate of the roller member as the rotating axis. In the conditions for the electron beam irradiation, the electronic current was adjusted to provide an accelerating voltage of 70 kV and a dose of 1000 kGy. Charging roller 1 was thus prepared.

Charging roller 1 had a diameter b of 50.0 μm, a diameter c of 20.0 μm, a volume-average particle diameter Mvb of 60.0 μm, a volume-average particle diameter Mvc of 24.0 μm, and a surface roughness Rzjis of 26.1 μm. The number of the hollow particles being completely within the "packing space just under a bowl" of a bowl-shaped resin particle was 4.2. The results are shown in Table 2.

6. Evaluation of banding image

A monochrome laser printer (trade name: "LBP6700") manufactured by CANON KABUSHIKI KAISHA, an electrophotographic apparatus having the structure shown in FIG. 9, was modified such that the process speed was 370 mm/sec, and a voltage was applied to the charging roller from the outside. The applied voltage was an AC voltage; the peak-to-peak voltage (Vpp) was 1800 V; the frequency (f) was 1350 Hz; the DC voltage (Vdc) was −600 V; and images were output at a resolution of 600 dpi.

The toner cartridge 52411 for the above-mentioned printer was used as the process cartridge. The accessory charging roller was detached from the toner cartridge, and charging roller 1 produced above was set by abutting against the electrophotographic photoreceptor with a spring at a pressing pressure of 4.9 N for one end, 9.8 N in total for both ends. This process cartridge was fit in a low-temperature and low-humidity environment, a temperature of 15° C. and a relative humidity of 10%, for 24 hr. Output was then performed to evaluate the banding image. A half-tone image (image of horizontal lines drawn with a width of one dot and an interval of two dots in the rotational and perpendicular directions to the electrophotographic photoreceptor) was output soon after the setting to the process cartridge.

The resulting half-tone image was visually observed whether banding, i.e., horizontal streaks due to the uneven concentration caused by unevenness in charging, was present or not and was judged based on the following criteria:

Rank 1: no banding was observed;

Rank 2: only slight banding was observed;

Rank 3: banding was partially observed at a pitch of the charging roller, but it did not practically matter; and Rank 4: distinct banding to reduce the image quality was observed.

The evaluation results of charging roller 1 are shown in Table 2. The banding image of charging roller 1 was evaluated as rank 1 showing good results.

Examples 2 to 22

Charging rollers 2 to 22 were produced as in Example 1 except that capsule particles A and B shown in Table 2 were used and were evaluated as in Example 1. The results are shown in Table 2. In charging rollers 2 to 22, the number of the hollow particles being completely within the "packing space just under a bowl" of a bowl-shaped resin particle was four or more, and the effect of absorbing vibration was high. Consequently, the evaluation for banding image gave satisfactory results.

TABLE 2

| | | Capsule particle A | | Capsule particle B | | b | c | Mvb | Mvc | Number of hollow particle* | Requirement | Rzjis | Banding image |
|---|---|---|---|---|---|---|---|---|---|---|---|---|---|
| Example | Charging roller | No | Parts by mass | No | Parts by mass | μm | μm | μm | μm | Number | (1) | μm | Rank |
| 1 | Charging roller 1 | 14 | 100 | 23 | 40 | 50.0 | 20.0 | 60.0 | 24.0 | 4.2 | Satisfied | 26.1 | 1 |
| 2 | Charging roller 2 | 14 | 100 | 24 | 47 | 50.0 | 18.0 | 60.0 | 21.6 | 5.3 | Satisfied | 26.1 | 1 |
| 3 | Charging roller 3 | 14 | 100 | 26 | 50 | 50.0 | 15.0 | 60.0 | 18.0 | 7.5 | Satisfied | 26.1 | 1 |
| 4 | Charging roller 4 | 4 | 100 | 15 | 46 | 120.0 | 41.4 | 144.0 | 60.0 | 6.1 | Satisfied | 57.1 | 2 |
| 5 | Charging roller 5 | 2 | 100 | 10 | 46 | 170.0 | 70.4 | 204.0 | 84.5 | 4.3 | Satisfied | 81.0 | 2 |
| 6 | Charging roller 6 | 3 | 100 | 11 | 48 | 150.0 | 62.0 | 180.0 | 74.4 | 4.5 | Satisfied | 71.4 | 2 |
| 7 | Charging roller 7 | 6 | 100 | 15 | 52 | 100.0 | 41.4 | 120.0 | 49.7 | 4.1 | Satisfied | 47.6 | 1 |
| 8 | Charging roller 8 | 8 | 100 | 18 | 44 | 80.0 | 33.0 | 96.0 | 39.6 | 4.2 | Satisfied | 41.7 | 1 |
| 9 | Charging roller 9 | 14 | 100 | 23 | 39 | 50.0 | 20.0 | 60.0 | 24.0 | 4.8 | Satisfied | 26.1 | 1 |
| 10 | Charging roller 10 | 20 | 100 | 28 | 54 | 30.0 | 12.4 | 36.0 | 14.9 | 4.2 | Satisfied | 15.6 | 2 |
| 11 | Charging roller 11 | 2 | 100 | 15 | 40 | 170.0 | 41.4 | 204.0 | 49.7 | 11.3 | Satisfied | 81.0 | 2 |
| 12 | Charging roller 12 | 3 | 100 | 16 | 40 | 150.0 | 37.5 | 180.0 | 45.0 | 11.2 | Satisfied | 71.4 | 2 |
| 13 | Charging roller 13 | 6 | 100 | 22 | 43 | 100.0 | 25.0 | 120.0 | 30.0 | 11.5 | Satisfied | 47.6 | 1 |
| 14 | Charging roller 14 | 8 | 100 | 23 | 54 | 80.0 | 20.0 | 96.0 | 24.0 | 11.8 | Satisfied | 41.7 | 1 |
| 15 | Charging roller 15 | 14 | 100 | 27 | 39 | 50.0 | 12.5 | 60.0 | 15.0 | 11.2 | Satisfied | 26.1 | 1 |
| 16 | Charging roller 16 | 20 | 100 | 31 | 53 | 30.0 | 7.5 | 36.0 | 9.0 | 11.3 | Satisfied | 15.6 | 2 |
| 17 | Charging roller 17 | 2 | 100 | 17 | 38 | 170.0 | 34.0 | 204.0 | 40.8 | 17.2 | Satisfied | 81.0 | 3 |
| 18 | Charging roller 18 | 3 | 100 | 20 | 54 | 150.0 | 30.0 | 180.0 | 36.0 | 17.4 | Satisfied | 71.4 | 3 |
| 19 | Charging roller 19 | 6 | 100 | 23 | 50 | 100.0 | 20.0 | 120.0 | 24.0 | 17.5 | Satisfied | 47.6 | 3 |
| 20 | Charging roller 20 | 8 | 100 | 25 | 45 | 80.0 | 16.0 | 96.0 | 19.2 | 17.1 | Satisfied | 41.7 | 3 |
| 21 | Charging roller 21 | 14 | 100 | 30 | 54 | 50.0 | 10.0 | 60.0 | 12.0 | 17.6 | Satisfied | 26.1 | 3 |
| 22 | Charging roller 22 | 20 | 100 | 32 | 52 | 30.0 | 6.0 | 36.0 | 7.2 | 17.8 | Satisfied | 15.6 | 3 |

*The number of hollow particles in the packing space just under a bowl

Comparative Examples 1 to 11

Charging rollers 23 to 33 were produced as in Example 1 except that capsule particles A and B shown in Table 3 were used and were evaluated as in Example 1. The results are shown in Table 3. In charging rollers 23 to 33, the number of the hollow particles being completely within the "packing space just under a bowl" of a bowl-shaped resin particle was less than four, and the effect of absorbing vibration was insufficient. Consequently, the evaluation rank of the evaluation banding image was 4.

TABLE 3

| Comparative Example | Charging roller | Capsule particle A No | Capsule particle A Parts by mass | Capsule particle B No | Capsule particle B Parts by mass | b μm | c μm | Mvb μm | Mvc μm | Number of hollow particle* Number | Requirement (1) | Rzjis μm | Banding image Rank |
|---|---|---|---|---|---|---|---|---|---|---|---|---|---|
| 1 | Charging roller 23 | 1 | 100 | 5 | 44 | 200.0 | 103.0 | 240.0 | 123.6 | 1.2 | Not-satisfied | 95.2 | 4 |
| 2 | Charging roller 24 | 2 | 100 | 7 | 53 | 170.0 | 87.5 | 204.0 | 105.0 | 1.6 | Not-satisfied | 81.0 | 4 |
| 3 | Charging roller 25 | 3 | 100 | 9 | 46 | 150.0 | 77.0 | 180.0 | 92.4 | 1.4 | Not-satisfied | 71.4 | 4 |
| 4 | Charging roller 26 | 4 | 100 | 11 | 49 | 120.0 | 62.0 | 144.0 | 74.4 | 2.3 | Not-satisfied | 57.1 | 4 |
| 5 | Charging roller 27 | 6 | 100 | 13 | 52 | 100.0 | 52.0 | 120.0 | 62.4 | 2.5 | Not-satisfied | 47.6 | 4 |
| 6 | Charging roller 28 | 8 | 100 | 15 | 54 | 80.0 | 41.4 | 96.0 | 49.7 | 2.9 | Not-satisfied | 41.7 | 4 |
| 7 | Charging roller 29 | 12 | 100 | 19 | 42 | 60.0 | 31.0 | 72.0 | 37.2 | 2.4 | Not-satisfied | 31.3 | 4 |
| 8 | Charging roller 30 | 14 | 100 | 22 | 40 | 50.0 | 25.0 | 60.0 | 30.0 | 3.1 | Not-satisfied | 26.1 | 4 |
| 9 | Charging roller 31 | 20 | 100 | 26 | 51 | 30.0 | 15.0 | 36.0 | 18.0 | 3.3 | Not-satisfied | 15.6 | 4 |
| 10 | Charging roller 32 | 23 | 100 | 30 | 47 | 20.0 | 10.0 | 24.0 | 12.0 | 3.6 | Not-satisfied | 10.4 | 4 |
| 11 | Charging roller 33 | 30 | 100 | 33 | 38 | 10.0 | 5.5 | 12.0 | 6.6 | 3.4 | Not-satisfied | 5.2 | 4 |

*The number of hollow particles in the packing space just under a bowl

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175933, filed Aug. 29, 2014, which is hereby incorporated by reference herein in its entirety.

What is claimed is:

1. A charging member comprising an electro-conductive substrate and an electro-conductive resin layer, wherein the electro-conductive resin layer includes a binder, a plurality of bowl-shaped resin particles, and a plurality of hollow particles;

the charging member has a surface having recesses defined by openings of the bowl-shaped resin particles and protrusions defined by edges of the openings of the bowl-shaped resin particles; and the electro-conductive resin layer satisfies a positional relationship between the bowl-shaped resin particles and the hollow particles defined by requirement (1):

requirement (1): at least 4.0 hollow particles existing within a region, the region being defined by orthographic projection of the bowl-shaped resin particle from the surface of the electro-conductive resin layer toward the depth direction, and being between an outer wall surface of a shell forming the recess of the bowl-shaped resin particle, and a plane $M_2$ which is parallel to the surface of the electro-conductive substrate and is passing through a point $p_2$ at a distance d of $b/(1+\sqrt{2})$ (μm) in the depth direction, from a point $p_1$ at a deepest position of the outer wall surface of the shell, where the symbol b in "$b/(1+\sqrt{2})$" represents a particle diameter (μm) of the bowl-shaped resin particle by spherical approximation.

2. The charging member according to claim 1, wherein the hollow particles each have a particle diameter c determined by spherical approximation within a range of b/5 (μm) or more and $b/(1+\sqrt{2})$ (μm) or less.

3. The charging member according to claim 1, wherein the particle diameter b is 50 μm or more and 150 μm or less.

4. A process cartridge detachably attachable to a main body of an electrophotographic apparatus, comprising a charging member, wherein the charging member comprises an electro-conductive substrate and an electro-conductive resin layer, wherein the electro-conductive resin layer includes a binder, a plurality of bowl-shaped resin particles, and a plurality of hollow particles;

the charging member has a surface having recesses defined by openings of the bowl-shaped resin particles and protrusions defined by edges of the openings of the bowl-shaped resin particles; and the electro-conductive resin layer satisfies a positional relationship between the bowl-shaped resin particles and the hollow particles defined by requirement (1):

requirement (1): at least 4.0 hollow particles existing within a region, the region being defined by an orthographic projection of the bowl-shaped resin particle from the surface of the electro-conductive resin layer toward a depth direction, and being between an outer wall surface of a shell forming the recess of the bowl-shaped resin particle, and a plane $M_2$ which is parallel to the surface of the electro-conductive substrate and is passing through a point $p_2$ at a distance d of $b/(1+\sqrt{2})$ (μm) in the depth direction, from a point $p_1$ at a deepest position of the outer wall surface of the shell, where the symbol b in "$b/(1+\sqrt{2})$" represents a particle diameter (μm) of the bowl-shaped resin particle by spherical approximation.

5. An electrophotographic apparatus comprising a charging member, an exposure device, and a developing device, wherein the charging member comprises an electro-conductive substrate and an electro-conductive resin layer, wherein the electro-conductive resin layer contains a binder, a plurality of bowl-shaped resin particles, and a plurality of hollow particles;

the charging member has a surface having recesses defined by openings of the bowl-shaped resin particles and protrusions defined by edges of the openings of the bowl-shaped resin particles; and the electro-conductive resin layer satisfies a positional relationship between the bowl-shaped resin particles and the hollow particles defined by requirement (1):

requirement (1): at least 4.0 hollow particles existing within a region, the region being defined by an orthographic projection of the bowl-shaped resin particle from the surface of the electro-conductive resin layer toward a depth direction, and being between an outer wall surface of a shell forming the recess of the bowl-shaped resin particle, and a plane $M_2$ which is parallel to the surface of the electro-conductive substrate and is passing through a point $p_2$ at a distance d of $b/(1+\sqrt{2})$ (μm) in the depth direction, from a point $p_1$ at the deepest position of the outer wall surface of the shell, where the symbol b in "$b/(1+\sqrt{2})$" represents a particle diameter (μm) of the bowl-shaped resin particle by spherical approximation.

* * * * *